United States Patent [19]

Spiteri

[11] 4,404,498

[45] Sep. 13, 1983

[54] MULTIPLEX STROBE LIGHT

[76] Inventor: Joseph Spiteri, P.O. Box 158, Harborcreek, Pa. 16421

[21] Appl. No.: 240,798

[22] Filed: Mar. 5, 1981

[51] Int. Cl.[3] ..... H05B 41/34

[52] U.S. Cl. ..... 315/241 R; 315/200 A; 315/232; 315/325; 340/331

[58] Field of Search ..... 315/228, 232, 241 R, 315/241 P, 312, 324, 325, 200 A, 201; 340/28, 77, 81 R, 81 F, 331

[56] References Cited

U.S. PATENT DOCUMENTS 3,772,564 11/1973 Leskin ..... 315/200 A 4,233,546 11/1980 Berthiaume ..... 315/241 R

*Primary Examiner*—Eugene R. LaRoche

*Attorney, Agent, or Firm*—Ralph Hammar

[57] ABSTRACT

A multiplex strobe light in which several ionized gas flash tubes are fed in parallel from a common power and trigger circuit. The common power circuit has a capacitor which is connected across a charging voltage and all of the flash tubes. The common trigger circuit has an SCR gated on by a zener when the charge on the capacitor reaches the desired voltage. Each flash tube has its own transformer with the secondary connected to its control electrode and the primary connected to a capacitor discharged through the SCR so the flash tubes are turned on simultaneously and share the power capacitor discharge.

7 Claims, 2 Drawing Figures

MULTIPLEX STROBE LIGHT

Figures 1, 2:
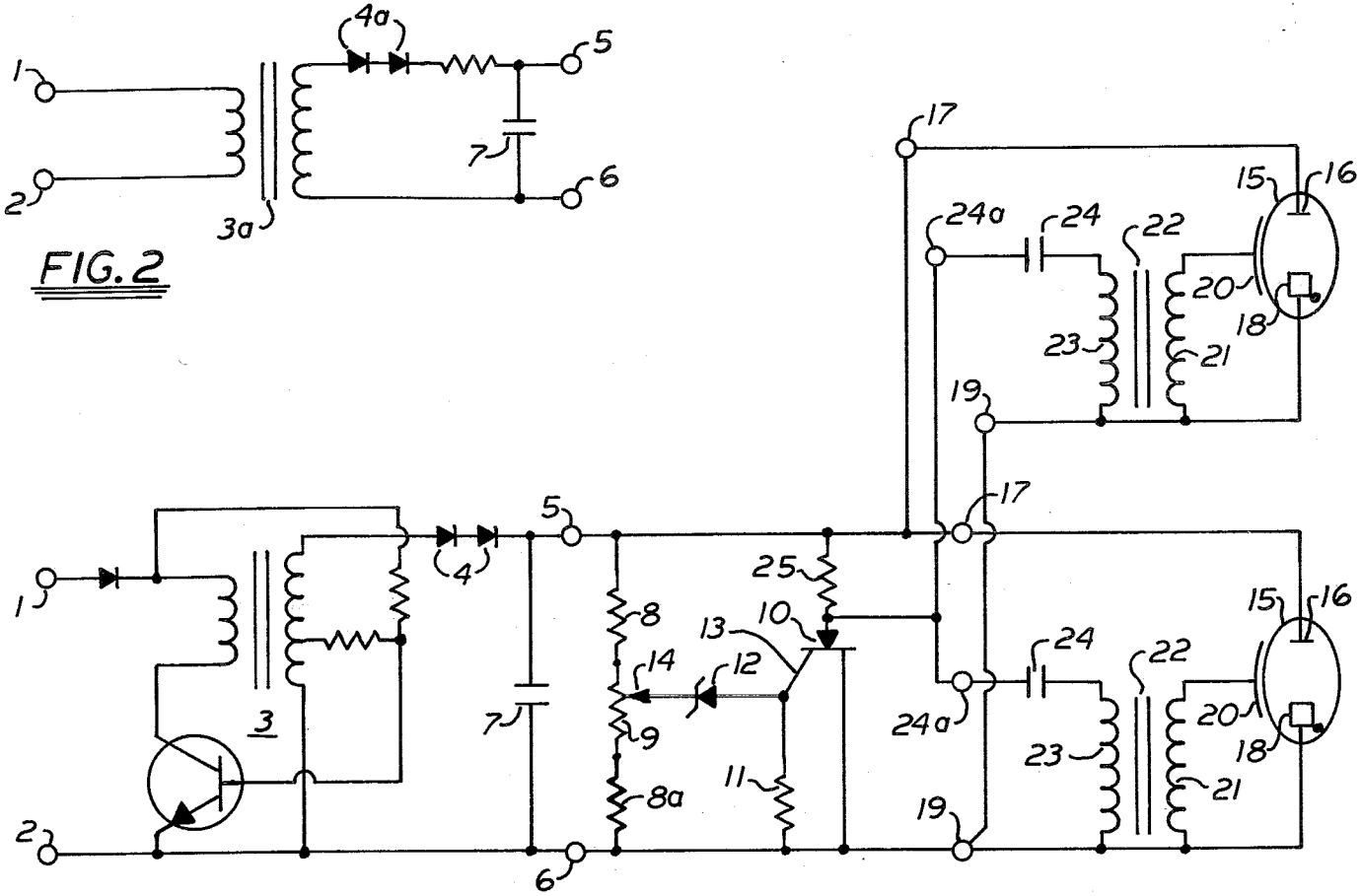

This invention is a multiplex strobe light such as used on trucks and the like for attracting attention so as to avoid collision accidents.

In the drawing, FIG. 1 is a circuit diagram with a DC supply, and

FIG. 2 is a supplemental diagram of an AC supply for use with the FIG. 1 circuit.

The lamp circuit is designed for operation on 12 volts DC or 120 volts AC power. When the power input at terminals 1, 2 is a 12 volt battery, the inverter 3 and diodes 4 produce an output at terminals 5, 6 of 450 volts pulsating DC. When the power input at terminals 1, 2 is 120 volts AC, the transformer 3*a* and diodes 4*a* produce an output at output terminals 5, 6 of 450 volts pulsating DC. With either power supply, a large capacitor (e.g., 100 microfarads) 7 is charged.

The power output terminals are connected to a trigger circuit which comprises resistors 8, 8*a*, 9 connected as a voltage divider across the terminals 5, 6, and SCR 10, and a resistor 11 connected between terminal 6 and the gate electrode 13 of the SCR. A zener diode 12 is connected between the gate electrode 13 of the SCR and the adjustable point 14 of resistor 9. When the voltage at point 14 reaches about 101 volts, the zener 12 breaks down connecting the voltage from point 14 to the gate electrode 13 of the SCR and causing the SCR to fire. The firing of the SCR controls one or more flash circuits, each consisting of a gas discharge flash tube such as Xenon lamp 15 having its anode 16 connected to terminal 17 and its cathode 18 connected to terminal 19. The control electrode 20 of the flash tube 15 is connected to output coil 21 of a transformer 22 having its input coil 23 connected to terminal 24*a* through a small capacitor (e.g., 0.22 microfarads) 24 to the anode of SCR 10. Before the control electrode 13 of the SCR is pulsed on, capacitor 24 is charged through resistor 25. As soon as the SCR is pulsed on, the capacitor 24 discharges through the SCR and coil 23 inducing a high voltage pulse (e.g. 6000 volts) in coil 21. Coil 21 is polarized so that the pulse appearing on the control electrode 20 is negative. This negative pulse turns the flashtube 15 on and discharges main condenser 7 producing a bright flash of short duration. For the particular circuit values described, a single lamp 15 would have a flash of 1,000,000 lumens.

FIG. 1 shows two flash lamps multiplexed or connected in parallel to the same power and trigger circuit. Each lamp has its own transformer 22 and receives the trigger pulse due to the discharge of its own capacitor 24 through its own transformer. Because the trigger pulses originate in a common SCR and the discharge of the capacitors 24 through the SCR and the primary coils 23 of the transformers, the lighting of the tubes 15 is so well synchronized that the tubes divide equally the discharge current from power capacitor 7 and produce flashes of 500,000 lumens each. The current through the tubes 15 is very brief so that if the induced voltages in the coil of the transformers were not precisely synchronized by the same SCR 10, the first tube to flash would take all or nearly all of the discharge current from the power capacitor 7 and the mere turning on of the control electrode 20 of the other flashtube or tubes would result in little or no light.

Multiplexing of the discharge tubes is very desirable in the trucking industry when it is desired that two tubes flash simultaneously, one on each side of the back side of a truck body, or that four tubes flash simultaneously, one on each corner of the back side of the truck body. Four tubes would produce flashes of 250,000 lumens each.

The power circuit starts at terminals 1, 2 and ends at terminals 5, 6. The trigger circuit starts at terminals 5, 6 and ends at terminals 17, 19. The flash circuits start at terminals 17, 24*a*, 19 and ends at the respective flash tubes.

It is possible to have a single capacitor 24 for more than one flash tube in which case the primary windings 23 of each tube would be connected in parallel to the single capacitor.

The embodiment of the invention in which an extensive property or privilege is claimed are defined as follows:

1. Apparatus for the simultaneous energization of a plurality of gas discharge lamps each having an anode, a cathode and a control electrode, said apparatus comprising: capacitive discharge means for storing electric energy and releasing the stored electric energy to the anodes and cathodes of the lamps, trigger capacitor means for storing electric energy and releasing the stored electric energy to the control electrodes and cathodes of the lamps, each lamp having a transformer with a secondary winding connected across its control electrode and its cathode and a primary winding connected across said trigger capacitor means, circuit means for providing electric energy to said capacitive discharge means and to said trigger capacitor means, circuit means for connecting the primary windings in parallel with each other and in series with the trigger capacitor means and for connecting each secondary winding individually to its control electrode, and switch means for discharging the trigger capacitor means through said primary windings, the polarity of the windings being such that the initial voltage induced in the secondary windings is negative at said control electrodes.

2. The apparatus of claim 1 in which the switch means is further defined as an SCR.

3. The apparatus of claim 2 in which the SCR is gated on by a zener diode responsive to the voltage to which said capacitive means has been charged.

4. The apparatus of claim 3 in which the zener diode is connected between a tap on a voltage divider across said capacitive means and the gate electrode of the SCR.

5. The apparatus of claim 4 in which the tap on the voltage divider is adjustable to vary the flashing frequency.

6. The apparatus of claim 1 in which the trigger capacitor means comprises a plurality of capacitors, one for each lamp and the capacitor for each lamp is connected in series with its primary winding.

7. The apparatus of claim 1 in which said lamps are Xenon lamps.

* * * * *